United States Patent [19]

Taylor et al.

[11] Patent Number: 4,627,675

[45] Date of Patent: Dec. 9, 1986

[54] WIRING SYSTEM WITH QUICK CONNECT WIRE TERMINALS

[76] Inventors: Richard D. Taylor; Phillip W. Stumpff, both of P.O. Box 802, Madill, Okla. 73446

[21] Appl. No.: 671,129

[22] Filed: Nov. 13, 1984

Related U.S. Application Data

[63] Continuation-in-part of Ser. No. 520,237, Aug. 4, 1983, abandoned.

[51] Int. Cl.[4] ..... H01R 4/66

[52] U.S. Cl. ..... 339/14 R; 339/122 R

[58] Field of Search ..... 339/14 R, 122, 95 D; 174/53, 58, 65

[56] References Cited

U.S. PATENT DOCUMENTS

| | | | |
|---|---|---|---|
| Re. 29,513 | 1/1978 | Johnson | 339/112 R |
| 2,725,544 | 11/1955 | Strange | 339/95 D |
| 2,738,482 | 3/1956 | Benander | 339/154 |
| 2,890,436 | 6/1959 | Bentley | 339/95 D X |
| 3,097,906 | 7/1963 | Shannon | 339/253 |
| 3,323,099 | 5/1967 | Spera | 339/192 |
| 3,339,170 | 8/1967 | Martin | 339/31 |
| 3,393,397 | 7/1968 | Manichl | 339/95 |
| 3,451,037 | 6/1969 | Herrli | 339/192 |
| 3,569,911 | 3/1971 | Bogdanowicz | 339/95 |
| 3,585,570 | 6/1971 | Jans | 339/95 |
| 3,717,840 | 2/1973 | Vaughan et al. | 339/198 R |
| 3,828,113 | 8/1974 | Bourne | 174/55 |
| 3,863,037 | 1/1975 | Schindler et al. | 174/58 |
| 3,885,852 | 5/1975 | Grove | 339/95 D |
| 3,916,149 | 10/1975 | Skinner | 219/335 |
| 3,922,478 | 11/1975 | Perkey | 174/53 |
| 3,936,126 | 2/1976 | Miller | 339/95 D |
| 3,945,711 | 3/1976 | Hohorst et al. | 339/95 D |
| 4,012,100 | 3/1977 | Viscosi | 339/95 D |
| 4,106,835 | 8/1978 | Kimm | 339/95 D |
| 4,165,443 | 8/1979 | Figart et al. | 174/53 |
| 4,166,934 | 9/1979 | Marrero | 200/51 R |
| 4,210,772 | 7/1980 | Magana et al. | 174/59 |
| 4,295,018 | 10/1981 | Borrelli | 200/51.09 |
| 4,336,418 | 6/1982 | Hoag | 174/53 |
| 4,420,215 | 12/1983 | Tengler | 339/176 R |

*Primary Examiner*—Eugene F. Desmond

*Attorney, Agent, or Firm*—Laney, Dougherty, Hessin & Beavers

[57] ABSTRACT

A plug-in electrical wiring apparatus includes an insulating housing having a cable receiving external socket disposed therein. The socket is defined by a bottom wall and a tapered side wall extending outward from the bottom wall. The side wall is convergingly tapered toward the bottom wall so that a cable inserted in the socket will wedgingly engage the tapered side wall. The bottom wall has a wire receiving housing opening disposed therethrough for receiving a first wire of the cable. An electrical contact strip is disposed in the housing for also receiving the wire of the cable. The contact strip includes a middle web portion having a wire receiving web opening in registry with the housing opening. The web portion further includes a resilient retaining tab for engaging the wire when the wire is inserted through the housing opening and the web opening and for resisting withdrawal of the wire from the web opening. The electrical contact strip further includes first and second leg portions extending from the web portion away from the housing opening, which leg portions are arranged to engagingly receive the wire of the cable therebetween.

21 Claims, 18 Drawing Figures

WIRING SYSTEM WITH QUICK CONNECT WIRE TERMINALS

RELATED APPLICATIONS

The present application is a continuation-in-part of our copending application Ser. No. 520,237 filed Aug. 4, 1983, now abandoned.

BACKGROUND OF THE INVENTION

1. Field Of The Invention

The present invention is related to plug-in type electrical wiring apparatus for use in constructing the wiring system of a house or other building.

2. Description Of The Prior Art

When a new building is being wired or an older building is being rewired, considerable time must be spent in making electrical connections within conventional junction, switch and receptacle boxes, and considerable time must also be spent in mounting such boxes. Accordingly, a need exists for an electrical connection box with which various two- and three-wire conductors may be quickly electrically connected in order to provide the electrical circuitry, and which may be quickly mounted from joists and studs.

The prior art does include wiring systems having plug-in type connections, such as seen, for example, in U.S. Pat. No. 4,165,443 to Figart et al.

Also, the prior art has included outlet boxes having offset flanges for mounting of the box on studs with the face of the box extending from the stud a distance equal to the thickness of wallboard to be used with the device, as seen in U.S. Pat. No. 3,863,037 to Schindler et al.

Other examples of various forms of electrical connection apparatus, including plug-in type connectors, and in some instances some of the other general structural and operational features of the present invention, include U.S. Pat. Nos. 3,885,852; 3,339,170; 3,393,397; 3,451,037; 3,569,911; 3,717,840; 3,828,113; 4,012,100; and 4,106,835.

In spite of the numerous attempts which have been made to develop a practical alternative to conventional junction, switch and receptacle boxes, some of which attempts are shown by the above cited references, none of these attempts have succeeded in providing a system which has found widespread acceptance in the marketplace. There is still the need for much improvement in plug-in type systems.

SUMMARY OF THE INVENTION

The present invention provides a number of improvements in plug-in type wiring systems.

An improved design is provided for an electrical contact strip disposed in an insulated housing. The strip includes a middle web portion having a wire receiving opening disposed therethrough in registry with a wire receiving housing opening of the housing. The web portion includes retaining means for engaging a wire when the wire is inserted through the housing opening and the web opening, and for resisting withdrawal of the wire from the web opening. The electrical contact strip further includes first and second leg portions extending from the web portion away from a wall of the housing through which the housing opening is disposed. The first and second leg portions are arranged to engagingly receive the wire therebetween when the wire is inserted through the housing opening and the web opening.

Also provided is a cable receiving external socket in the housing. The socket is defined by a bottom wall and a tapered side wall extending outward from the bottom wall. The side wall is convergingly tapered toward the bottom wall so that when a conventional wiring cable is inserted within the socket, the cable will wedge within the tapered side wall of the socket.

Numerous objects, features and advantages of the present invention will be readily apparent to those skilled in the art upon a reading of the following disclosure when taken in conjunction with the accompanying drawings.

DETAILED DESCRIPTION OF THE INVENTION

THE EMBODIMENT OF FIGS. 1-8

Figure 1:
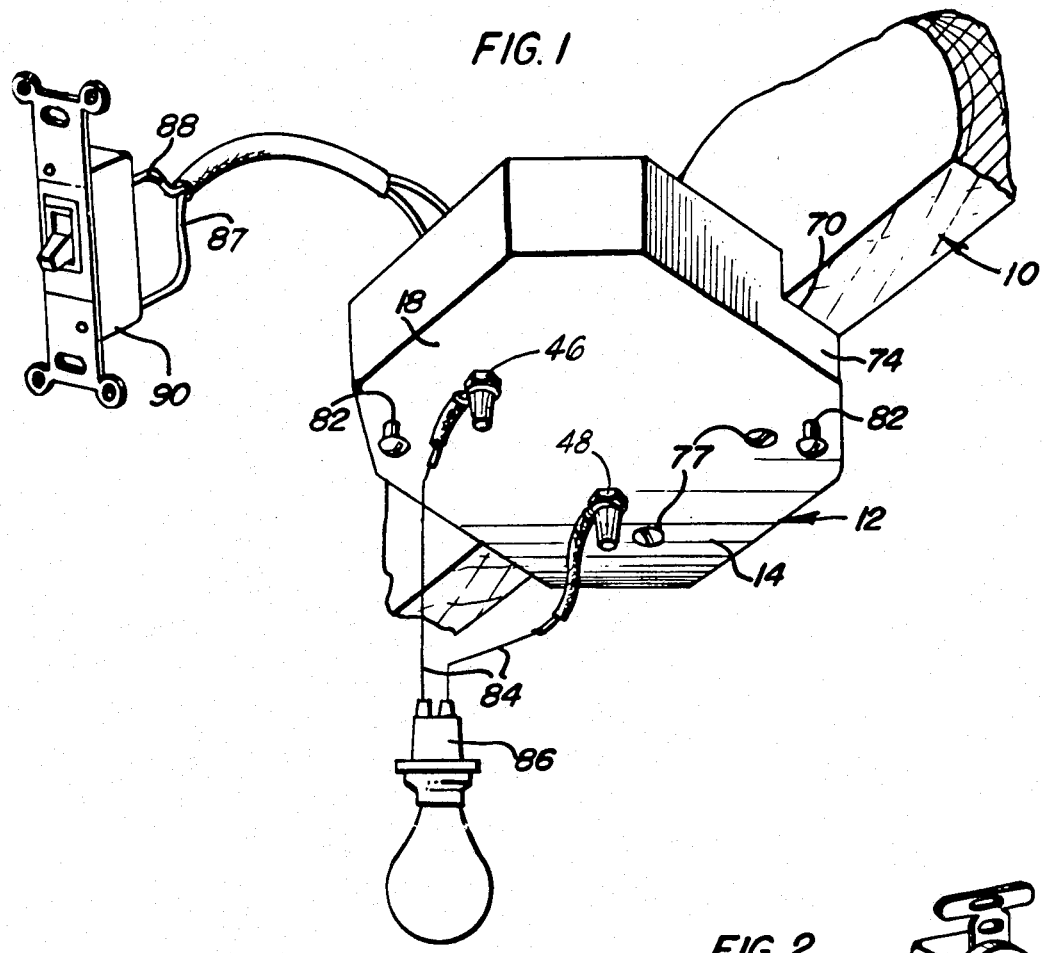
FIG. 1 is a fragmentary perspective view of a ceiling joist illustrating the manner in which the electrical connection box of the instant invention may be operatively supported from the joist and further illustrating the manner in which an electrical connection between a ceiling light and the connection box may be accomplished, a wall switch for controlling the light being also electrically connected to the connection box.

Referring now more specifically to the drawings, the numeral 10 generally designates a joist from which an electrical connection box constructed in accordance with the present invention is mounted. The electrical connection box is referred to in general by the reference numeral 12 and includes a housing 14 constructed of dielectric material, including a first side wall portion 16 and a second side wall portion 18 remote from the first side wall portion 16.

Figure 5:
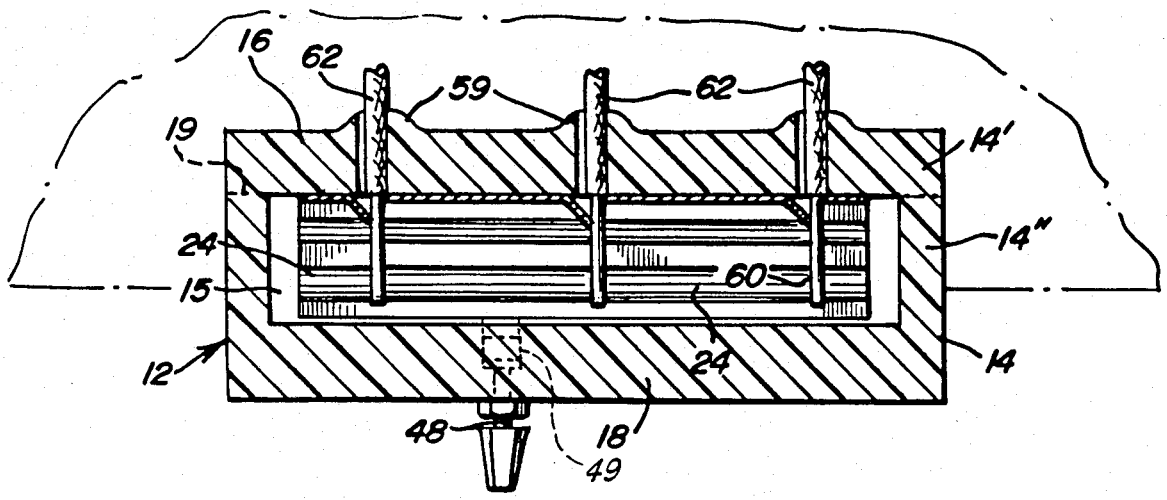
FIG. 5 is a vertical sectional view taken substantially upon the plane indicated by the section line 5—5 of FIG. 3.
Figure 6:
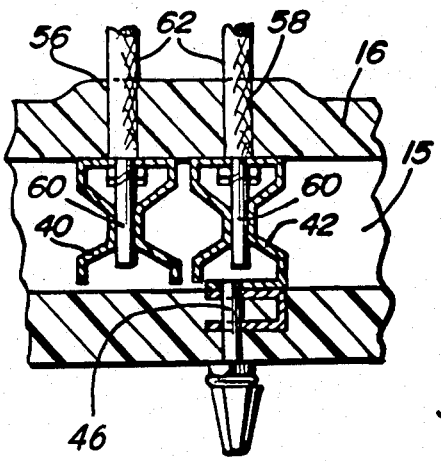
FIG. 6 is a fragmentary sectional view taken along line 6—6 of FIG. 4 illustrating the manner in which the ceiling light terminal may be electrically connected to the power bar of the connection box.

Although the housing 14 is illustrated as a one-piece construction, it is to be noted that the housing 14 is constructed of upper and lower halves 14' and 14'' fusion welded or otherwise joined together as at 19 (see FIG. 5). The housing 14 is constructed of a dielectric material such as plastic.

Figure 3:
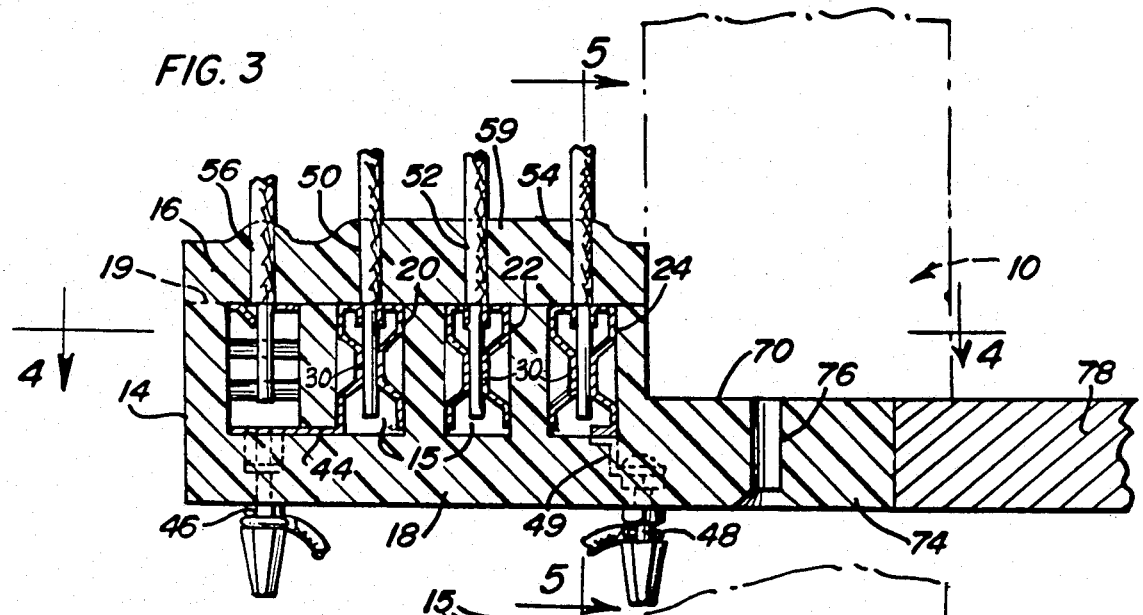
FIG. 3 is an enlarged fragmentary vertical sectional view of the connection box with an associated joist being illustrated in phantom lines.
Figure 4:
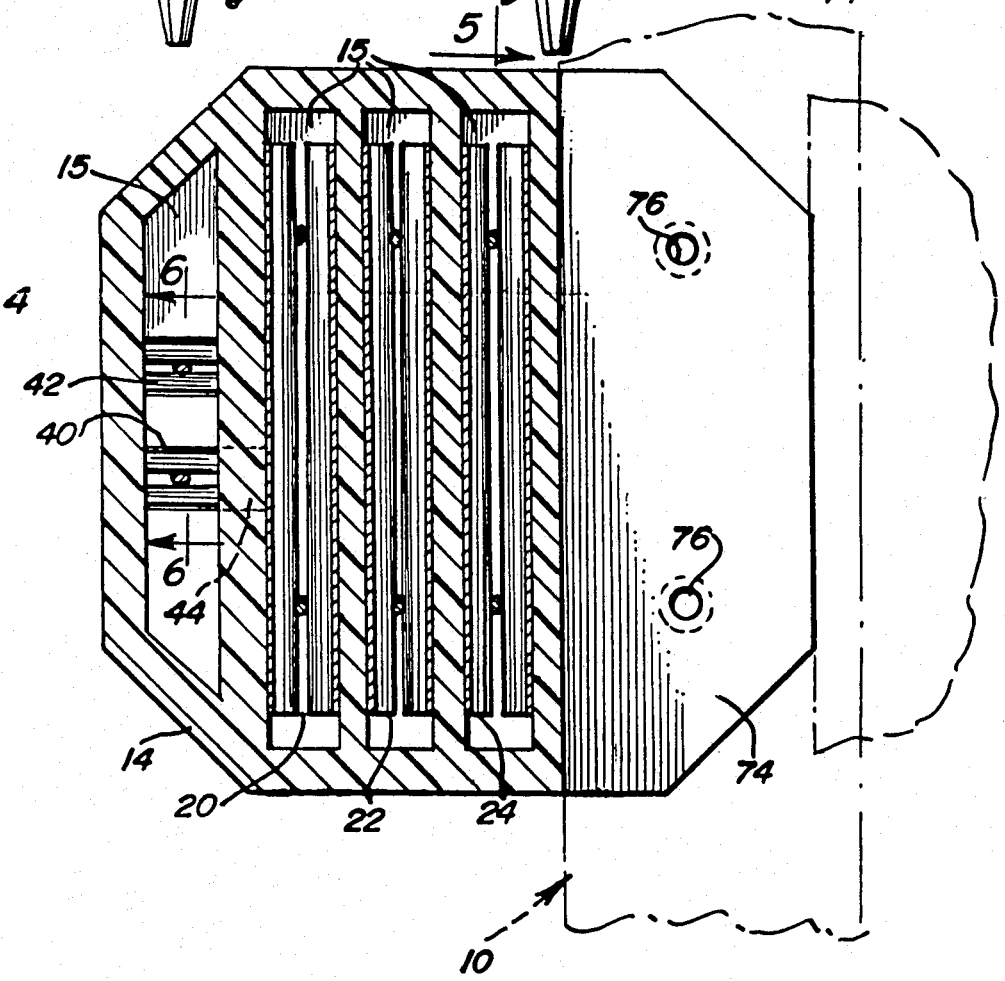
FIG. 4 is a horizontal sectional view taken substantially upon the plane indicated by the section line 4—4 of FIG. 3.
Figure 7:
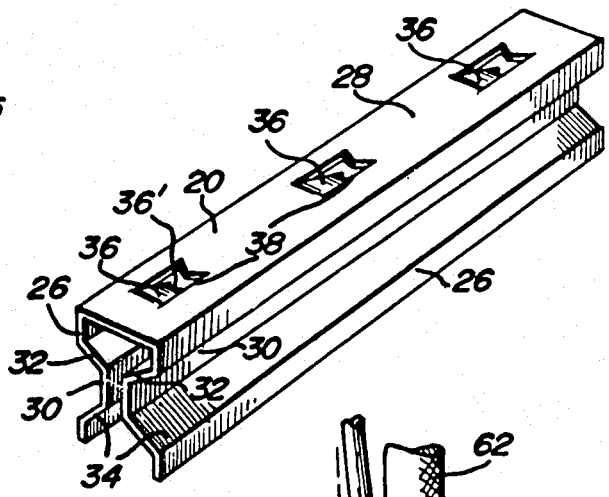
FIG. 7 is an enlarged perspective view of a portion of one of the three bars of the connection box.

Mounted within cavities 15 of the housing half 14'' are first, second and third power, ground and common elongated conductor means or bars 20, 22 and 24, respectively, and each of the bars 20, 22 and 24 comprises a channel member including opposite side flanges, or leg portions, 26 interconnected by a bight, or web, portion 28 and wherein the planar midportions 30 of the flanges 26 are laterally offset toward each other by oppositely inclined portions 32 and 34 of the flanges 26 (see FIG. 7), the lower ends of the flanges 26 being spaced from the lower extremities of the cavities 15 in order to enable the ends of associated wires to force apart and be received between the flange midportions 30 (see FIG. 3).

Bars 20, 22 and 24 may also be referred to as electrical contact strips.

Each of the bars 20, 22 and 24 includes laterally struck and angled tongue portions, or resilient tabs, 36 cut from the bight portion 28 and spaced along the corresponding bar, the tongue portions including free end notches 36'. The cutting of the tongue portions 36 from the bight portion 28 defines openings 38 registered with the space between the contact flanges 32. Further, the bars 20, 22 and 24 are insulatably mounted relative to each other within the housing 14 and the housing 14 further includes a pair of terminal clips 40 and 42 relatively insulatably mounted therein. Each of the clips 40 and 42 may be in the form of short bars otherwise similar in construction to the bars 20, 22 and 24. The terminal clip 40 is electrically connected to the bar 20 by a connecting strap 44 and the other terminal clip 42 has a terminal 46 electrically connected thereto which projects outwardly of the side wall portion 18. In addition, a second terminal 48 is provided and projects outwardly of the side wall portion 18 and is electrically connected with bar 24 by a connecting strap 49.

The side wall portion 16 has a plurality of sets of housing openings 50, 52 and 54 formed therein registered with the bars 20, 22 and 24 and with the sets of openings spaced along the bars. Further, the side wall portion 16 also has a pair of housing openings 56 and 58 formed therethrough registered with the terminal clips 40 and 42.

Figure 8:
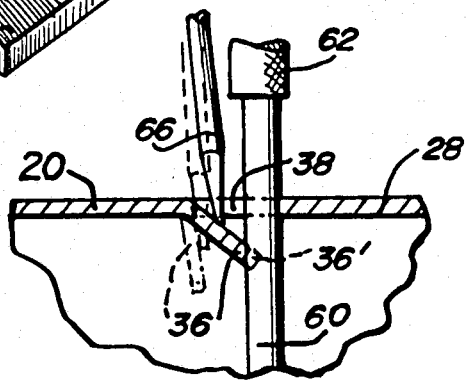
FIG. 8 is a fragmentary enlarged sectional view illustrating the manner in which a wire end connected to one of the bars of the connection box may be released from engagement therewith.

The openings 50, 52, 54, 56 and 58 are formed through raised portions 59 of the side wall portion 16 and are adapted to receive wire ends 60 therethrough. The openings are not only of sufficient size to receive the wire ends therethrough but also the insulated coatings 62 disposed about those wire ends. The wire ends may be received through corresponding openings and forced into openings 38. The forcing of the wire ends 60 through the openings 38 sufficiently deflects the free ends of the tongues 36 to enable the wire ends 60 to be received through the openings 38 and the tongues 36 prevent withdrawal of the wire ends through the openings 38. However, a slender tool shank 66 may be inserted through an opening formed in the side wall portion 16 and inwardly toward engagement with the associated tongues 36 in order to deflect the latter to the phantom line position thereof illustrated in FIG. 8 in order to enable the associated wire ends 60 to be withdrawn from the opening 38.

The housing 14 defines an open-ended notch 70 formed therein which opens laterally outwardly of the side wall portion 16 and which may receive the opposing marginal edge of the joist 10. The notch 70 of the housing 14 defines a mounting flange 74 through which a pair of bores 76 are formed and suitable fasteners 77 may be secured through the bores 76 in order to mount the flange 74 to the joist 10. The thickness of the flange 74 is substantially the same thickness as a ceiling panel 78 supported from the joist 10 and in this manner the outer surface of the side wall portion 18 may be flush with the under surface of the ceiling panel 78. Of course, housing 14 may also be mounted from a stud in substantially the same manner and thus have the outer surface of its side wall portion 18 flush with the surface of an associated wall panel corresponding to the ceiling panel 78. Further, the thickness of the flange 74 may vary, according to the thickness of the ceiling or wall panel to be used.

It will also be noted from FIG. 1 of the drawings that the side wall portion 18 includes a plurality of threaded bores 82 formed therein in which mounting screws may be threadedly engaged for supporting a ceiling light fixture from the housing 14. In addition, the conductor wires 84 from a ceiling light bulb socket 86 may be connected to the terminals 46 and 48 and the wire ends of a pair of conductors 87 and 88 extending from a wall-mounted switch 90 may be inserted through the openings 56 and 58 for electrical connection with the terminal clips 40 and 42. In this manner, the wall switch 90 may be utilized to actuate and deactuate the associated ceiling light including the bulb socket 86.

Figure 2:
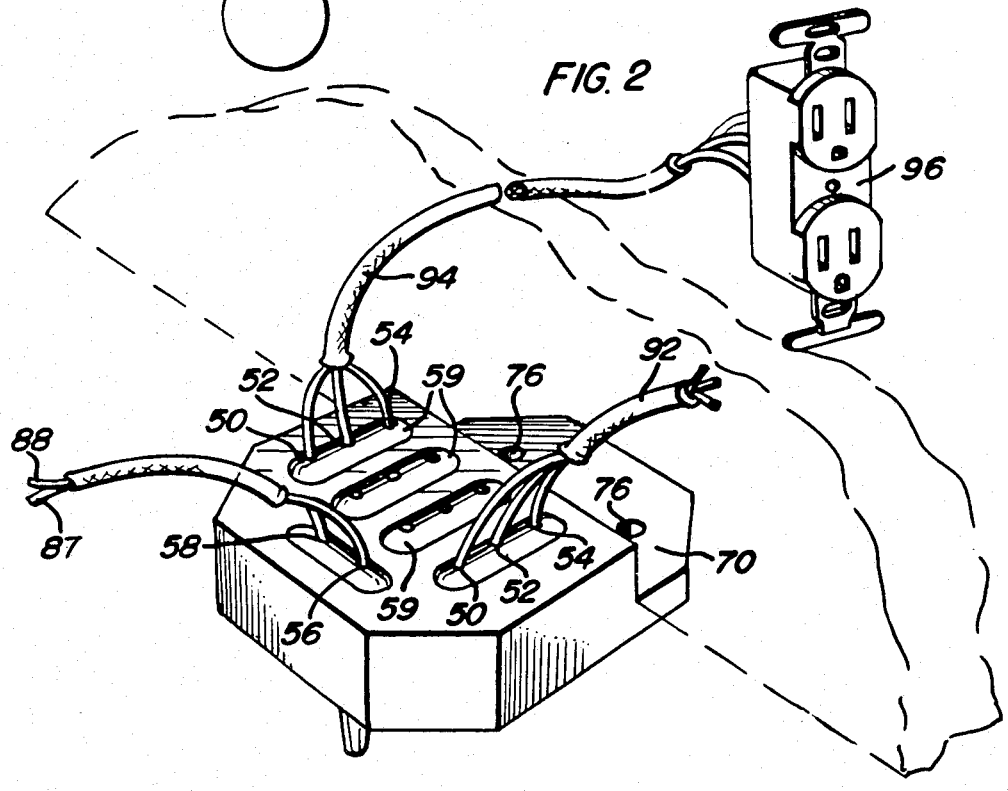
FIG. 2 is a further perspective view of the assemblage illustrated in FIG. 1 wherein the wall switch is broken away and illustrating the manner in which a wall mounted receptacle may be also electrically connected to the connection box.

FIG. 2 of the drawings illustrates the manner in which a three-conductor cable 92 extending from a source may have its wire ends electrically connected with the bars 20, 22 and 24 through a corresponding set of openings 50, 52 and 54 and also the manner in which a three-conductor cable 94 extending to a remote wall-mounted receptacle 96 may have its three wire ends electrically connected with the bars 20, 22 and 24 through another set of the openings 50, 52 and 54. Of course, additional three-wire conductors extending to further remote wall-mounted receptacles or the like may also be operatively associated with the electrical connection box 12.

From the foregoing, it may be seen that three- or two-wire conductors may be readily electrically connected to the bars 20, 22 and 24 and the terminal clips 40 and 42 merely by inserting the bare wire ends through the openings 50, 52 and 54 and also the openings 56 and 58. Further, the terminals 46 and 48 projecting outwardly of the side wall portion 18 of the housing 14 greatly facilitate the electrical connection of the conductors 84 of a ceiling light with the electrical connection box 12. Further, all wiring to remote areas may be readily made to the connection box 12 and the notch 70 greatly facilitates the mounting of the box 12 from a joist or stud flush with the exposed surface of an associated ceiling or wall panel. Of course, all of these features greatly facilitate putting in the wiring of an associated building or rewiring a building and the construction of the box 12 is such that it may be readily mass-produced at a low cost.

Since all of the exposed ends of the wires electrically connected to the box 12 internally of the latter are fully enclosed within the box, electricians may not only rough-wire a new house, but complete and make hot all wiring before dry wall or other wall and ceiling panels are to be put up. Thus, an electrician need not return to a new house after the wall and ceiling panels have been put up in order to accomplish final wiring. Further, the full wiring of a new house with the instant invention may be accomplished in less time than only rough wiring by present methods.

THE EMBODIMENT OF FIGS. 9–18

Figure 9:
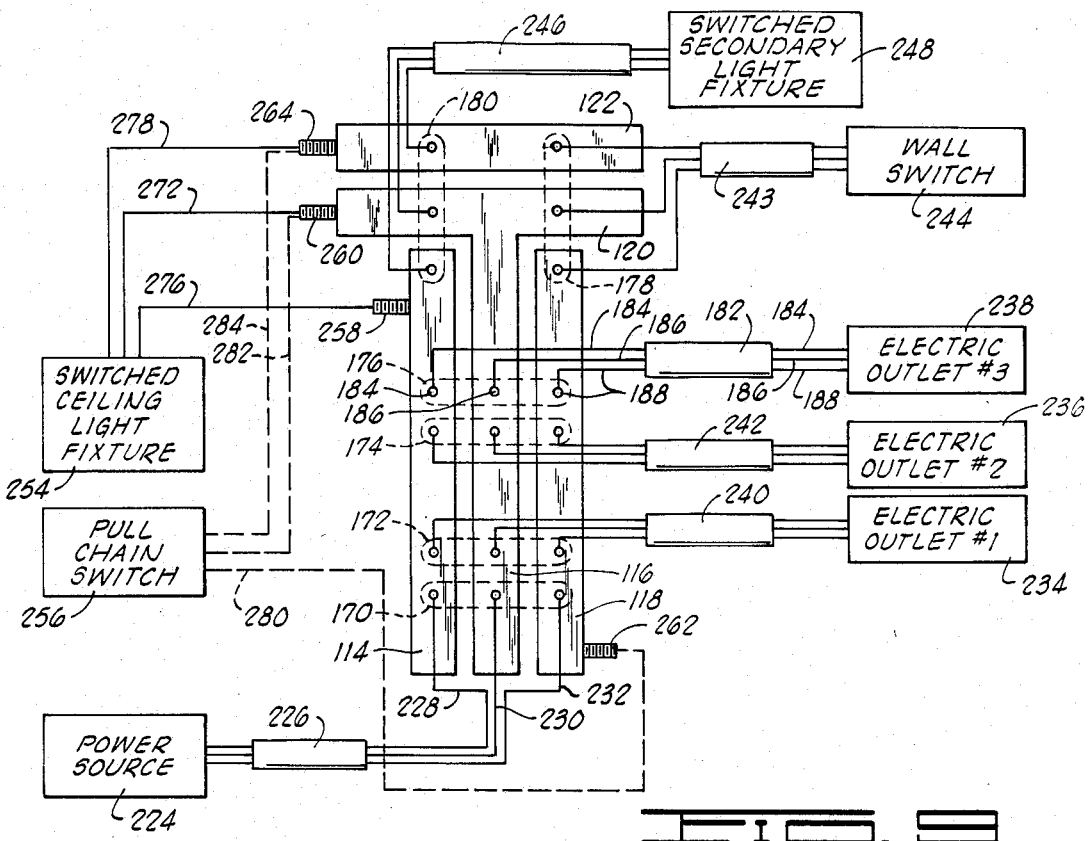
FIG. 9 is a schematic illustration of a complete wiring system utilizing an alternative embodiment of an electrical wiring apparatus such as the one shown in FIG. 10.
Figure 10:
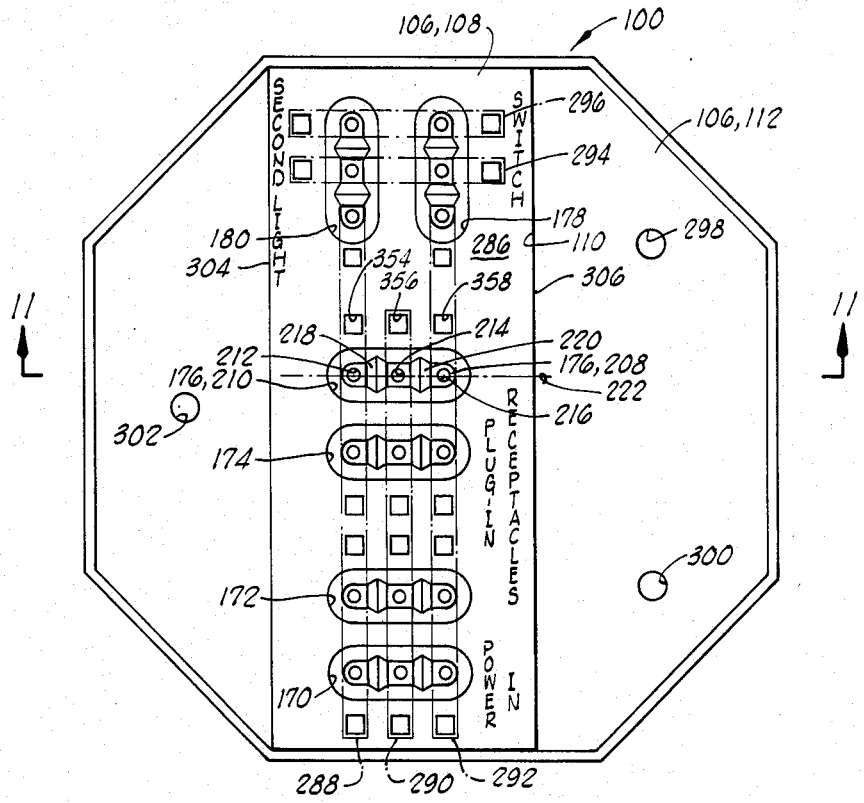
FIG. 10 is a plan view of an alternative embodiment of an electrical wiring apparatus.
Figure 11:
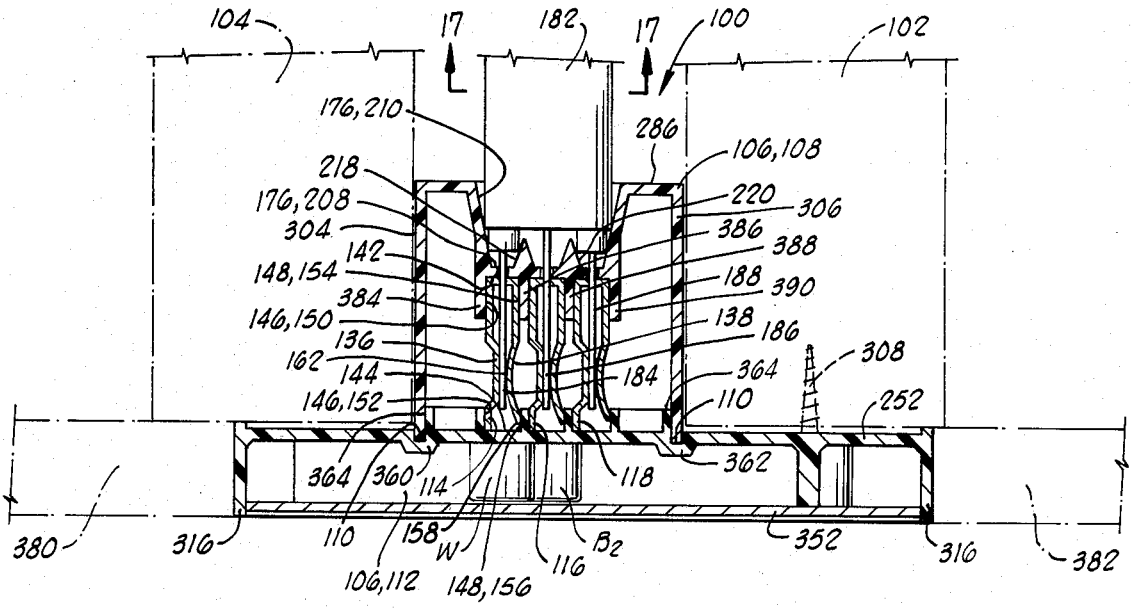
FIG. 11 is a section elevation view of the apparatus of FIG. 10 taken along line 11—11 of FIG. 10.

In FIGS. 9–18, an alternative embodiment of the present invention is shown. With particular reference to FIGS. 10 and 11, a plug-in electrical wiring apparatus is thereshown and generally designated by the numeral 100.

The apparatus 100 is particularly constructed for attachment to the lower surface of one or more ceiling beams such as 102 and 104, and replaces a conventional electrical junction box.

The apparatus 100 includes an insulating housing 106 constructed from a dielectric material such as plastic.

The housing 106 includes an upper first housing section 108 which is received within a rectangular groove 110 of a bottom second housing section 112.

Figure 12:
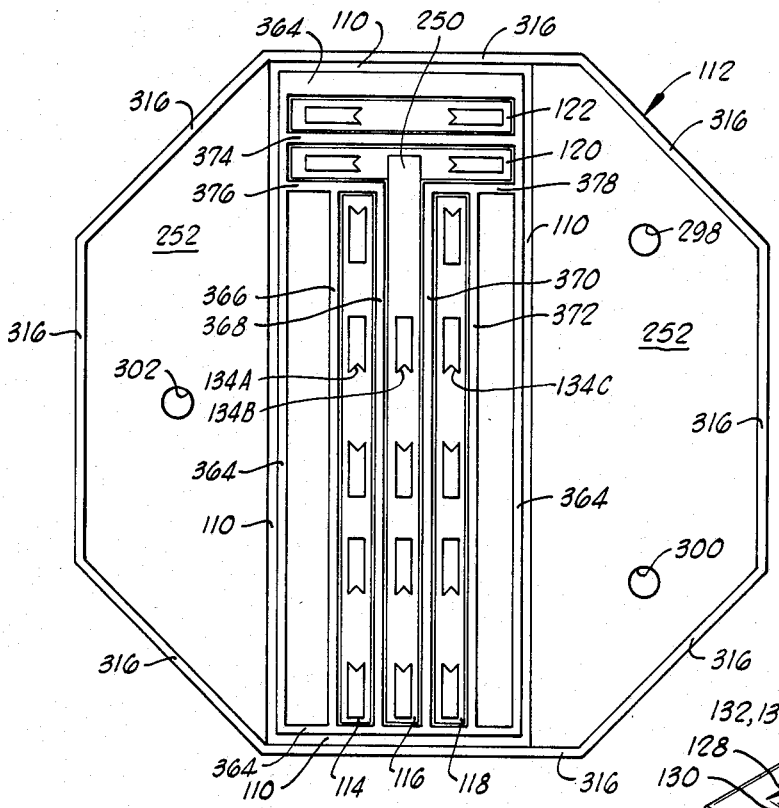
FIG. 12 is a plan view of the bottom housing section of the apparatus of FIG. 11, showing the electrical contact strips in place within the bottom housing section.

Received within the housing 106 are five electrical contact strips 114, 116, 118, 120 and 122, as best seen in FIG. 12 which is a top plan view of bottom second housing section 112 with the upper first housing section 108 removed.

Strip 114 is referred to as a common contact strip. Strip 116 is referred to as a ground contact strip 116. Strip 118 is referred to as a power contact strip 118. Strip 120 is referred to as a ground extension contact strip 120. Strip 122 is referred to as a switched power strip 122.

Figure 13:
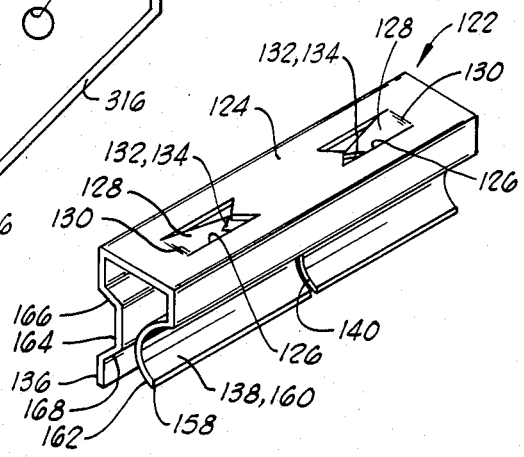
FIG. 13 is an isometric view of one of the electrical contact strips such as seen in FIGS. 11 and 12.

The construction of the strips 114–122 may best be understood with reference to FIGS. 11 and 13. In FIG. 11, the strips 114, 116 and 118 are each seen in cross-section view, and in FIG. 13, and strip 122 is shown in an oblique perspective view.

Each of the strips 114–122 are similarly constructed in that their cross sections are identical, and the manner of construction of the openings in the top portion thereof are identical. The lengths and placement of the strips, of course, are different as shown in FIG. 12.

Referring now to FIG. 13, the general construction of any one of the strips 114–122 will be described with particular reference to the strip 122 thereshown.

The contact strip 122 includes a middle elongated web portion 124 having wire-receiving web openings 126 disposed therethrough.

The web opening 126 is formed by punching a resilient tab 128 from web 124. The tab 128 may further be described as a retaining means 128 for engaging and retaining a wire inserted through the web opening 126 and for resisting withdrawal of such a wire from the web opening 126 as is further described below.

Each of the resilient tabs 128 has a fixed end 130 integrally attached to web portion 124, and has a free end 132. As seen in FIG. 13, the free ends 132 are deflected downwardly from the web portion 124.

The free ends 132 of the resilient tabs 128 have V-notches 134 disposed therein for engaging a wire.

The strip 122 further includes first and second elongated leg portions 136 and 138 extending downwardly from the web portion 124. The leg portions 136 and 138 are arranged to engagingly receive a wire therebetween as best seen in FIG. 11.

As seen in FIG. 13, the second leg portion 138 has a split 140 oriented transversely to a length of the elongated strip 122, between adjacent web openings 126. The split 140 permits different size wires to be received through adjacent web openings 126. Due to the split 140, the second leg 138 on either side of the split can flex differently so that different size wires can both be snugly engaged between the legs 136 and 138.

Referring now to FIG. 11, it is seen that each of the strips 114–122 is disposed in a groove of the housing 106. With particular reference to the strip 114, the strip 114 is disposed in a groove defined by an upper first wall 142, a lower second wall 144 opposed to first wall 142, and opposed third and fourth walls 146 and 148 extending at least partially between the first and second walls 142 and 144.

The first and second walls 142 and 144 are defined on the first and second housing sections 108 and 112, respectively.

The third wall 146 has first and second separate portions 150 and 152, respectively, integrally formed on first and second housing sections 108 and 112, respectively.

Similarly, fourth wall 148 has first and second separate portions 154 and 156 integrally formed on first and second housing sections 108 and 112, respectively.

The web portion 124 of common contact strip 114 engages upper first wall 142, and the lower end of first leg portion 136 of common contact strip 114 engages lower second wall 144.

The second leg portion 138 of common contact strip 114, however, has a lower free end 158 which engages lower second portion 156 of fourth wall 148 and which is spaced above lower second wall 144.

The second leg portion 138 is a flexible leg portion and is constructed so that it is flexed upon insertion of a wire between first and second leg portions 136 and 138. As the second leg portion 138 is flexed upon insertion of the wire between leg portions 136 and 138, the lower free end 158 thereof slides downwardly along lower second portion 156 of fourth wall 148 towards the lower second wall 144.

A lower portion 160 of second leg portion 138 is arcuate in cross section and has a convex side 162 facing first leg portion 136.

The first leg portion 136 has a planar part 164 which is adjacent and offset toward the arcuate part 160 of second leg portion 138.

When a wire is inserted between the first and second leg portions 136 and 138, it is engagingly gripped between the convex side 162 of arcuate portion 160 of second leg portion 138 and the planar part 164 of first leg portion 136.

As the wire is inserted between the first and second leg portions 136 and 138, the first leg portion 136 remains relatively fixed, since its lower end engages the lower second wall 144, and the arcuate cross-section portion 160 of second leg portion 138 flexes by flattening the arc thereof. This causes the second leg portion 138 to be resiliently biased against the wire so that it pushes against the wire and accordingly pushes the wire against the planar part 164 of first leg portion 136.

Due to the large flat area of planar part 164, a large area of electrical contact is provided between the wire and the first leg portion 136.

The first leg portion 136 includes sloped portions 166 and 168 joining the offset planar part 164 with the remainder of first leg portion 136.

Figure 16:
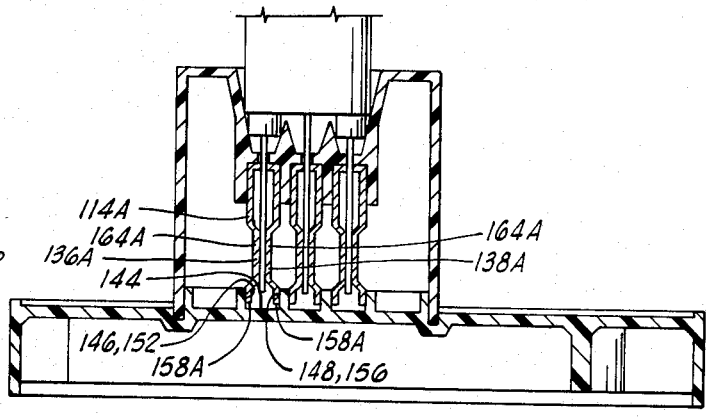
FIG. 16 is a view similar to FIG. 11, showing an alternative design for the electrical contact strips.

Referring briefly now to FIG. 16, an alternative design is thereshown for the electrical contact strips, in which alternative design both the first and second leg portions 136A and 138A are constructed to resiliently flex away from each other when a wire is received therebetween.

Each of the leg portions 136A and 138A are constructed somewhat similar to the first leg portion 136 of FIG. 11, except, however, most importantly, the free lower ends 158A thereof engage the lower portions 152 and 156 of third and fourth walls 146 and 148, respectively, and are spaced above the second wall 144. When a wire is inserted between the leg portions 136A and 138A of strip 114A of FIG. 16, both the first and second leg portions 136A and 138A are flexed away from each other, and the lower free ends 158A thereof both move closer to the second wall 144.

Each of the first and second leg portions 136A and 138A are constructed with offset planar portions 164A, which are substantially parallel to each other and are arranged so that a wire inserted between the first and second leg portions 136A and 138A is engagingly gripped between the offset planar portions 164A.

Referring now to FIG. 10, the upper first housing section 108 has six cable-receiving external sockets 170, 172, 174, 176, 178 and 180 disposed therein.

As will be further explained below, socket 170 is a power inlet socket. Sockets 172, 174 and 176 are plug-in receptacle sockets. Socket 178 is a wall switch connecting socket. Socket 180 is a light fixture connecting socket.

Each of the sockets 170–180 is identical in construction. Socket 176 is shown in cross section in FIG. 11, and the following description thereof is applicable to each of the sockets 170–180.

Each of the sockets 170–180 is constructed for use with a cable 182.

Figure 17:
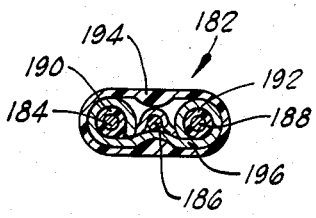
FIG. 17 is a section view along line 17—17 of FIG. 11 showing a cross section of a typical cable.

The construction of the cable 182 is best seen in FIG. 11 wherein the end of the cable is seen in elevation, and in FIG. 17 which is a cross-sectional view of the typical cable.

The cable 182 includes first, second and third substantially coplanar, substantially parallel wires 184, 186 and 188. As will be understood by those skilled in the art, wire 184 is a common wire 184, wire 186 is a ground wire 186, and wire 188 is a power wire 188.

The common and power wires 184 and 188 are insulated wires and have first and second substantially circular cross-section resilient tubular insulating sheaths 190 and 192, respectively, disposed thereabout. The insulating sheaths 190 and 192 are typically a rubber-like plastic material.

Located between the insulated common wire 184 and the insulated power wire 188 is the ground wire 186 which generally is not covered with an insulating sheath.

The three wires 184, 186 and 188 are all received within a substantially oval cross-section resilient tubular insulating casing 194. Typically, the three wires 184, 186 and 188 are wrapped with a plurality of wraps of paper wrapping 196 which separates them from each other and from the casing 194.

Figure 18:
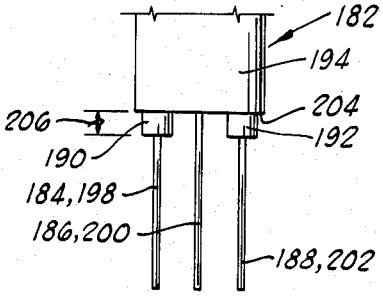
FIG. 18 is a side elevation view of a lower portion of an electric cable constructed for use with the present invention.

For use with the present invention, the cable 182 must have its three ends constructed in a particular manner as best seen in FIG. 18.

In FIG. 18, the cable 182 is shown in side elevation view analogous to the view seen in FIG. 11. There, it is seen that free end portions 198, 200 and 202 of first, second and third wires 184, 186 and 188, respectively, extend beyond a free end 204 of casing 194, and at least a part of the free end portions 198, 200 and 202 extending beyond free end 204 of casing 194 is bare.

The first and second insulating sheaths 190 and 192 disposed about common wire 184 and power wire 188, respectively, extend a distance 206 beyond the free end 204 of casing 194.

Referring again to FIG. 11, the following detailed description of the socket 176 thereshown in cross section can best be understood relative to the description just given of the cable 182.

The socket 176 is defined by a bottom wall 208 and a tapered side wall 210 extending outward from bottom wall 208.

The side wall 210 is convergingly tapered downward toward the bottom wall 208. The tapered side wall 210 is illustrated as having a somewhat inverted cone shape with a substantially oval cross section, which is the preferred shape. Tapered side wall 210 could, however, be differently shaped, for example with a rectangular cross section, or with one tapered wall and one opposed vertical wall, so long as at least one tapered surface of substantial size is provided to wedgingly engage the casing 194 of cable 182.

The bottom wall 208 has first, second and third aligned housing openings 212, 214 and 216 (see FIG. 10), respectively, disposed therethrough.

The housing openings 212, 214 and 216 are in registry with V-notches 134A, 134B, and 134C, of common strip 114, ground strip 116, and power strip 118, respectively, as seen in FIG. 12.

Similarly, the pairs of three housing openings seen in each of the other sockets 170, 172, 174, 178 and 178 in FIG. 10 are in registry with the V-notches in the associated contact strips located therebelow, which can readily be determined by comparison of FIGS. 10 and 12, and by the dashed ovals seen in FIG. 9.

When the cable 182 is inserted within the cable receiving socket 176, the bare free end portions 198, 200 and 202 of first, second and third wires 184, 186 and 188 are disposed through the first, second and third housing openings 212, 214 and 216, respectively. Also, the substantially oval cross-section casing 194 of cable 182 is wedgingly engaged with the tapered side wall 210 of socket 176 as best seen in FIG. 11.

The socket 176 further includes first and second tapered midwalls 218 and 220, respectively.

The first housing opening 212 is located between tapered side wall 210 of socket 176 and the first tapered midwall 218, so that the first insulating sheath 190 is wedgingly engaged with the first tapered midwall 218 and the tapered side wall 210.

The third housing opening 216 is located between the tapered side wall 210 and the second tapered midwall 220, so that the second insulating sheath 192 is wedgingly engaged with the tapered side wall 210 and the second tapered midwall 220.

The first, second and third wires 184, 186 and 188 which are disposed through the first, second and third housing openings 212, 214 and 216 are received through the corresponding web openings 126 of common strip 114, ground strip 116, and power strip 118, respectively.

The wires 184, 186 and 188 are each forced between the first and second leg portions 136 and 138 of common strip 114, ground strip 116, and power strip 118, respectively, as is best seen in FIG. 11.

When the wires 184, 186 and 188 are inserted into the strips 114, 116 and 118, the arcuate cross section second leg portion 138 of each of the strips 114, 116 and 118 flexes to allow the corresponding wire to be received between the legs of the strip and to firmly engage the wire due to the resilient biasing action of the arcuate second leg portion 138 of the respective strip.

As best seen in FIG. 10, the cable receiving socket 176 is oval in cross section, and the first, second and third housing openings 212, 214 and 216 are aligned parallel to a longest cross-sectional axis 222 of the socket 176.

When the cable 182 is inserted within the socket 176, it is very snugly held therein through a combination of the resilient gripping action of the strips 114, 116 and 118 on the wires 184, 186 and 188, in combination with the wedging action of the casing 194 within the tapered side wall 210, and the sheaths 190 and 192 between the tapered side wall 210 and the first and second tapered midwalls 218 and 220, respectively.

Referring now to the schematic illustration of FIG. 9, an overall system utilizing the plug-in electrical wiring apparatus 100 is thereshown. The circuitry of the apparatus 100 is represented by the schematic illustration of the electrical contact strips 114, 116, 118, 120 and 122 thereshown. The strips 114–122 are oriented in a manner corresponding to that seen in FIG. 12. The contact between wires such as 184, 186 and 188 with the common strip 114, ground strip 116 and power strip 118 are represented in FIG. 9 by small circles.

The particular contacts corresponding to the sockets 170, 172, 174, 176, 178 and 180 are designated by dashed oval lines generally corresponding to the outer circumference of each of the sockets, which dashed lines are designated by the numerals 172–180 corresponding to the sockets 172–180.

An electrical power source 224 is schematically shown near the bottom of FIG. 9. A power lead-in cable 226, which is a typical cable like the cable 182 shown in FIGS. 17 and 18, connects the power source 224 to the power inlet socket 170.

The power inlet cable 226 includes a common wire 228, a ground wire 230, and a power wire 232 which are connected to the common strip 114, the ground strip 116, and the power strip 118.

The electrical contacts associated with the plug-in receptacle sockets 172, 174 and 176 may be connected to first, second and third electrical outlets 234, 236 and 238, respectively, by cables 240, 242, and 182, respectively.

Each of the outlets 234, 236 and 238 may be conventional electrical outlets like the outlet 96 shown in FIG. 2, or preferably, they may be of a plug-in type design utilizing plug-in strips similar to the strips 114, 116 and 118 shown in FIG. 11.

The electrical contacts associated with switch socket 178, which are readily apparent in FIG. 9, are connected by a cable 243 to a wall switch 244.

When the wall switch 244 is turned on, the power strip 118 is connected with the switched power strip 122.

The wall switch 244 may be constructed in a conventional manner like the switch 90 shown in FIG. 1, or preferably, it is constructed using plug-in type electrical connections like those illustrated in FIG. 11.

Switched secondary light fixture socket 180 has its associated electrical contacts connected by a cable 246 with a switched secondary light fixture 248. The light fixture 248 is controlled by the wall switch 244, so that when wall switch 244 is turned on to connect power strip 118 with switched power strip 122, current will then be conducted to the light fixture 248 to turn on the same.

It will be appreciated in viewing FIGS. 9 and 12 that common strip 116 is always electrically connected to common extension strip 120. This is illustrated in FIG. 12 by an overlapping tab 250 of web portion 124 of common strip 116, which overlays the web portion 124 of common extension strip 120.

Thus, there are actually four electrically independent strips contained in the apparatus 100. They are the common strip 114, the ground strips 116 and 120, the power strip 118, and the switched power strip 122.

Each of these electrically independent strips has wiring attachment studs extending vertically downward through an upper wall 252 of bottom second housing section 112 for connection of wires from a switched ceiling light fixture 254, and also in some instances, a pull chain switch 256.

A first stud 258 extends downward from common strip 114. A second stud 260 extends downward from common strips 116 and 120. A third stud 262 extends downward from power strip 118. A fourth stud 264 extends downward from switched power strip 122.

The electrical connecting studs 258–264 are shown schematically in FIG. 9.

Figure 15:
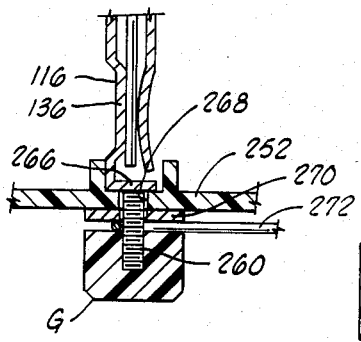
FIG. 15 is a section elevation view of a fixture wiring stud and associated knob as taken along line 15—15 of FIG. 14.

FIG. 15 illustrates the manner in which the second stud 260 is connected to the ground strip 116.

The first leg portion 136 of ground strip 116 has an underturned horizontal tab 266 to which the stud 260 is welded.

The stud 260 extends downward through an opening 268 in upper wall 252 of bottom second housing section 112.

Attached to stud 260 is an electrical contact plate 270.

The stud 260 is designed to have an electrical wire 272 wound thereabout and held in place thereon against electrical contact plate 270 by a threaded plastic connector knob G which is threaded onto stud 260 to firmly hold the wire 272 against electrical connecting plate 270.

Figure 14:
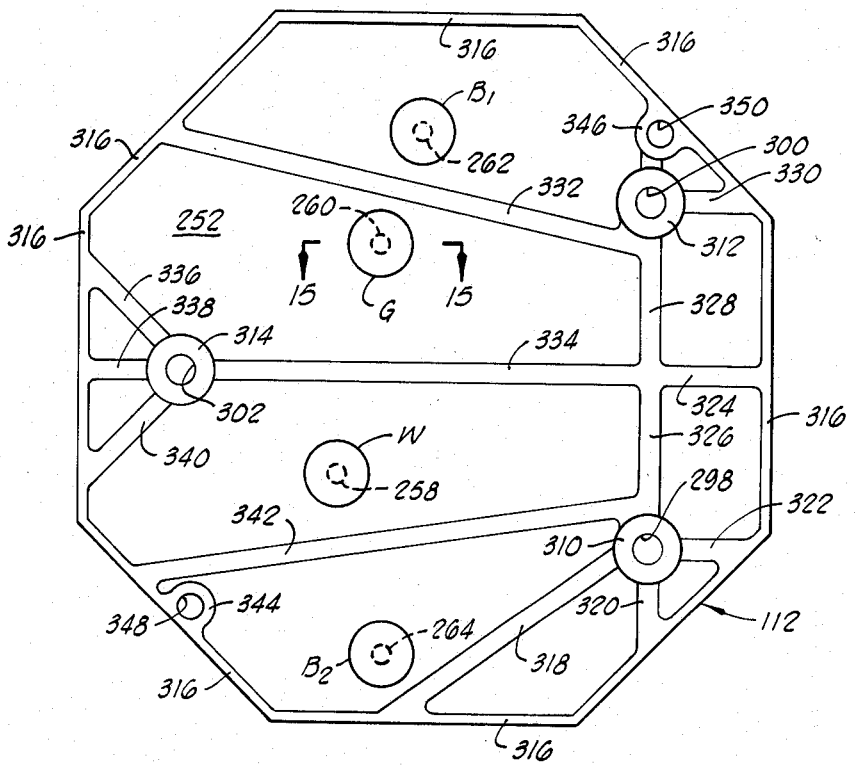
FIG. 14 is a bottom view of the bottom housing section of the apparatus of FIGS. 10–12.

FIG. 14, which is a bottom view of bottom second housing section 112 shows in dotted lines the actual locations of the studs 258–264.

Returning now to the description of FIG. 9, the switched ceiling light fixture 254 is typically mounted directly below the apparatus 100 and has the wire 272 connecting the ground stud 260 to the fixture 254, along with common and power wires 276 and 278, respectively, connecting the fixture 254 to the common stud 258 and the switched power stud 264.

The switched ceiling light fixture 254 is controlled by wall switch 244.

As an alternative to use of the wall switch 244, it is sometimes desired to provide a pull chain switch 256 which is directly connected to the apparatus 100 and typically is associated with the switched ceiling light fixture 254.

If the pull chain switch 256 is utilized, the wall switch 244 and associated cable 243 are removed. The pull chain switch will have a first wire 280 connected to power stud 262, a ground wire 282 connected to ground stud 260, and a third wire 284 connected to switched power stud 264.

Thus, when the pull chain switch 256 is in an on position, it will electrically connect the wires 280 and 284, and accordingly will electrically connect the power strip 118 and the switched power strip 122. Thus, the switched ceiling light fixture 254 and/or the switched secondary light fixture 248 may be controlled by the pull chain switch 256 instead of by the wall switch 244.

Referring now to FIGS. 10, 11, 12 and 14, some further details of the construction of housing 106 will be described, in addition to some details of the manner in which the housing 106 is typically mounted to the ceiling beams such as 102 and 104.

The apparatus 100 is constructed by placing the electrical contact strips 114–122 in place within the bottom second housing section 112 as shown in FIG. 12, and by then placing the upper first housing section 108 in place within the groove 110 of bottom second housing section 112 as seen in FIG. 11. Preferably, the upper and lower housing sections 108 and 112 are connected through the use of cement at the groove 110.

Each of the electrical contact studs 258–264 has a plastic knob like the knob G thereon.

As seen in FIG. 14, the four knobs are designated as $B_1$, G, W and $B_2$. These designations correspond to the color of the knobs. The knobs $B_1$ and $B_2$ are black. The knob G is green. The knob W is white.

These colors correspond to the typical colors utilized on conventional cable. The insulating sheath 190 on the common wire 184 is always colored white, and accordingly the knob W is associated with the common strip 114.

The second insulating sheath 192 disposed about the power wire 188 is always colored black, and accordingly the knobs $B_1$ and $B_2$ which are associated with the power strip 118 and the switched power strip 122 are colored black.

The ground wire 186, if it is insulated, is typically insulated with green insulation, and accordingly the knob G on stud 260 associated with ground strips 116 and 120 is colored green.

To further aid in this color coding of the apparatus 100, an upper surface 286 of upper first housing section 108 has five colored indica strips 288, 290, 292, 294 and 296 thereon. The indicia strips 288–296 are represented in FIG. 10 by dashed lines, for ease of illustration, but it will be appreciated that they are in some manner printed or attached to the upper surface 286 to indicate that the various openings such as openings 212, 214 and 216 covered by the indicia strips are associated with a respective one of the electrical contact strips 114–122 located within the apparatus 100. All of the housing openings associated with a particular contact strip such as common strip 114 are aligned with the corresponding indicia strip such as 288.

The indicia strip 288 is white, since it corresponds to the common strip 114 which is to be connected to common wires such as 184 having a white insulation such as 190 thereon.

Second and fourth indicia strips 290 and 294 are both colored green since they are associated with the ground strips 116 and 120. Third and fifth indica strips 292 and 296 are colored black since they are associated with the power strip 118 and the switched power strip 122.

The bottom second housing section 112 has first, second and third attachment holes 298, 300 and 302 disposed therethrough.

As seen in FIG. 11, the top surface of bottom second housing section 112, in combination with side walls 304 and 306 of upper first housing section 108 defines two 90° notches which may readily receive ceiling beams such as 102 and 104 thereagainst. By placing the apparatus 100 against a ceiling beam such as 102, the apparatus 100 may readily be attached to the ceiling beam 102 through the use of wood screws such as 308 shown in phantom lines disposed through the attachment holes 298 and 300.

In a typical installation, the apparatus 100 will only be mounted on a single ceiling beam such as 102, through the use of two wood screws disposed through the attachment holes 298 and 300.

In some instances, however, it is desired to hang a heavy load from the apparatus 100, such as for example when mounting a chandelier. In such an instance, a second ceiling beam such as 104 may be appropriately attached to the ceiling structure, and then attached to the apparatus 100 with a third wood screw disposed through the attachment hole 302. This greatly increases the physical load which can be hung from the apparatus 100, since the apparatus 100 is no longer mounted in a cantilevered fashion.

The upper and lower housing sections 108 and 112 illustrated in FIGS. 10, 11, 12 and 14 are preferably manufactured by plastic injection molding.

FIG. 14 is a bottom view of the bottom second housing section 112 and it shows various reinforcing ribs which support the upper wall 252 thereof. It is seen that there are cylindrical reinforcing sections 310, 312, and 314 associated with the screw attachment holes 298, 300 and 302, respectively.

There is an octagonal-shaped side wall 316 extending around and downward from the perimeter of upper wall 252.

There are a plurality of interconnecting ribs 318–342 which extend between the various cylindrical reinforcing portions 310, 312 and 314 and the octagonal side wall 316 and the upper wall 252.

Additionally, built-up sections 344 and 346 have screw receiving holes 348 and 350 disposed therein, respectively, for attaching a metal support plate 352 (see FIG. 11) to the bottom housing section 112.

The metal support plate 352 is utilized when it is desired to attach a heavy item such as a chandelier to the apparatus 100. The support plate 352 will have suitable openings (not shown) disposed therein to receive various wiring from the device being hung, and will provide suitable means for direct support of the device such as the chandelier being hung.

As seen in FIG. 10, each of the housing openings such as 212, 214 and 216 has associated therewith a square opening such as 354, 356, and 358, respectively. The square openings such as 354, 356 and 358 are access openings for a tool such as the tool 66 shown in FIG. 8, which engages the resilient tabs 128 near their fixed ends 130, so that they may be deflected downward to release the respective wires received through the openings 212, 214 and 216, in a manner similar to that previously described with regard to FIG. 8.

Also as seen in FIG. 10, there is lettering indicia displayed adjacent the sockets 170–180 indicating the item which should be connected to each of the sockets.

The socket 170 is labeled "POWER IN". The sockets 172, 174 and 176 are collectively labeled "PLUG-IN RECEPTACLES". The socket 178 is labeled "SWITCH". The socket 180 is labeled "SECOND LIGHT".

Referring now to FIG. 12, further details are there seen of the bottom housing section 112.

The octagonal-shaped upper wall 252 is surrounded by the perimeter wall 316 previously described.

The rectangular groove 110 previously described is disposed in the upper wall 252, and as can be seen in FIG. 11, the upper wall 252 is enlarged as shown as 360 and 362 to provide appropriate strengthening adjacent the groove 110.

An inner perimeter rib 364 is rectangular in shape and extends vertically upward from upper wall 252 immediately within the limits set by rectangular groove 110.

Four parallel long ribs 366, 368, 370 and 372 extend vertically upward from upper wall 252 for receiving the lower ends of the electrical contact strips 114, 116 and 118, respectively.

Similarly, shorter transverse ribs 364, 376, and 378 receive the lower ends of electrical contact strips 120 and 122. As can be seen in FIG. 12, the space between ribs 368 and 370 is openly communicated with the space between the rib 374 and the two short ribs 376 and 378, to allow the ground strip 116 to contact the ground extension strip 120.

As seen in FIG. 11, the bottom housing section 112 has a vertical thickness equal to the thickness of wallboard sections 380 and 382 which are attached to the bottom of the ceiling beams 102 and 104 in a conventional manner.

For conventional one-half inch thick wallboard, the bottom housing section 112 will have a thickness of one-half inch so that it fits flush with the bottom surface of the wallboard sections 380 and 382.

Each of the sockets such as socket 176 seen in FIG. 11, of upper housing section 108 has four parallel vertically downward extending short ribs 384, 386, 388 and 390 extending vertically downward from the bottom wall 208 thereof for receiving the upper ends of the electrical contact strips such as 114, 116 and 118.

SUMMARY OF OPERATION OF THE PRESENT INVENTION

A wiring system such as that shown in FIG. 9 based upon the plug-in type wiring apparatus 100 provides a very much improved system as compared to conventional present-day wiring systems wherein junction boxes, outlet boxes and switch boxes are hand-wired.

This is particularly true if the electrical outlets 234, 236 and 238 and the wall switch 244 are also constructed in a manner similar to the apparatus 100 having plug-in type connectors similar to that illustrated in FIG. 11 utilizing electrical contact strips like strips 114, 116 and 118 and a plug-in housing socket such as 176.

With such a system, the multi-step wiring process currently predominantly used, which requires the electrical contractors to visit the construction sites several times to prewire, and to final-wire a building, is eliminated and is replaced by a process which only requires the electrical contractor to make a single visit to the construction site.

For example, to wire the system shown in FIG. 9, the electrical contractor first connects the power cable 226 to the plug-in socket 170.

Assuming that the contractor desires to connect three electrical outlets 234, 236, 238, the wall switch 244, a ceiling light fixture 254, and a switch secondary light fixture 248 to the apparatus 100, that is accomplished in the following manner.

The electrical contractor plugs in cables 240, 242, 182, 243 and 246 into the plug-in sockets 172, 174, 176, 178 and 180, respectively. Those cables 240, 242, 182, 243 and 246 are then placed within the building structure so that they run to the appropriate locations for the terminal devices attached to the other ends thereof.

Then, the apparatus 100 is placed against a ceiling beam such as 102 and connected thereto by two screws such as 308.

Then, the cables 240, 242, 182 and 243 may be connected to electrical outlets 234, 236 and 238 and wall switch 244, respectively, preferably by a plug-in type connection similar to that previously described with regard to the apparatus 100. Those electrical outlets 234, 236 and 238 and wall switch 244 also are preferably constructed similar to the apparatus 100 so that they have a flange portion corresponding to the bottom housing section 112 which can be directly nailed on the front face of a vertical wooden stud of a wall.

The cable 246 will typically be hand-wired to the switched secondary light fixture 248, or of course the light fixture 248 could be constructed for a plug-in type connection like that previously described with regard to FIG. 11.

The switched ceiling light fixture 254 is hand-wired to the electrical connection studs 258, 260 and 264 as previously described with regard to FIG. 15.

Then, all that is necessary is for the other end of power cable 226 to be connected to power source 224 at which time the entire system shown in FIG. 9 is completed and is connected to electrical power so that it may be used from that point forward.

The electrical contractor is then finished with installation of the system shown in FIG. 9, and there is no need to return to the construction site for any final wiring procedure.

An additional benefit provided by a system such as that shown in FIG. 9 is that as soon as the power source 224 is connected, the electrical outlets 234, 236 and 238 may be utilized by the electrical contractor to power his tools which are utilized in construction of remaining portions of the electrical system of the particular building involved. That is not possible with typical present-day wiring practices where the wiring system is not final-wired and connected to a power source until the structure is essentially completed.

Thus it is seen that the apparatus of the present invention readily achieves the ends and advantages mentioned as well as those inherent therein. While certain preferred embodiments of the invention have been illustrated for the purposes of the present disclosure, numerous changes in the arrangement and construction of parts may be made by those skilled in the art, which changes are encompassed within the scope and spirit of the present invention as defined by the appended claims.

What is claimed is:

1. A plug-in electrical wiring apparatus, comprising:

an insulating housing, having a wire receiving housing opening disposed through a wall thereof; and an electrical contact strip disposed in said housing, said strip including:

a middle web portion having a wire receiving web opening disposed therethrough in registry with said wire receiving housing opening, said web portion further including retaining means for engaging said wire when said wire is inserted through said housing opening and said web opening and for resisting withdrawal of said wire from said web opening; and first and second leg portions extending from said web portion away from said wall of said housing, said leg portions being arranged to receive said wire therebetween, such that said wire is grippingly engaged by said leg portions.

2. The apparatus of claim 1, wherein:

said housing opening is one of a plurality of aligned housing openings disposed through said wall of said housing; and said web portion of said contact strip is an elongated web portion, and said web opening is one of a plurality of aligned web openings disposed through said elongated web portion, each one of said web openings being in registry with one of said housing openings.

3. The apparatus of claim 1, wherein:

said electrical contact strip is disposed in a groove of said housing, said groove being defined by first, second, third and fourth walls of said housing;

said first wall being said wall through which said wire receiving housing opening is disposed;

said second wall being opposite said first wall; and said third and fourth walls being opposed walls extending at least partially between said first and second walls.

4. The apparatus of claim 4, wherein:

said housing includes first and second housing sections constructed to be joined together after said electrical contact strip is placed in said groove; and said first and second walls are defined on said first and second housing sections, respectively.

5. The apparatus of claim 4, wherein:

said third wall has first and second separate portions integrally formed on said first and second housing sections, respectively; and said fourth wall has first and second separate portions integrally formed on said first and second housing sections, respectively.

6. The apparatus of claim 1, wherein:

said retaining means of said web portion of said electrical contact strip is a resilient tab punched from said web portion, said tab having a fixed end integrally attached to said web portion and having a free end extending from said web portion away from said wall of said housing.

7. The apparatus of claim 6, wherein:

said free end of said tab has a V-notch therein for engaging said wire.

8. A plug-in electrical wiring apparatus, comprising:

a housing having an external socket means disposed therein for receiving a cable, said socket means being defined by a tapered side wall convergingly tapered toward a lower end of said socket means so that said cable will wedgingly engage said tapered side wall when said cable is inserted in said socket means;

first, second and third aligned wire receiving housing openings, disposed through said lower end of said socket means, for receiving first, second and third wires, respectively, of said cable;

wherein said socket means further includes first and second tapered midwalls;

wherein said first housing opening is located between said side wall and said first tapered midwall so that an insulating sheath of said first wire will wedgingly engage said first tapered midwall when said first wire is inserted through said first housing opening;

wherein said second housing opening is located betwen said first and second midwalls for receiving a second wire of said cable; and wherein said third housing opening is located between said side wall and said second tapered midwall so that an insulating sheath of a third wire of said cable will wedgingly engage said second tapered midwall when said third wire is inserted through said third housing opening.

9. The apparatus of claim 8, wherein:

said socket means is substantially oval in cross section; and said first, second and third housing openings are aligned parallel to a longest cross-sectional axis of said socket means.

10. The apparatus of claim 8, further comprising:

first, second and third wire receiving electrical contact means disposed in said housing in registry with said first, second and third housing openings, for receiving said first, second and third wires of said cable.

11. The apparatus of claim 8, wherein:

said first tapered midwall is arranged so that said insulating sheath of said first wire will be wedgingly engaged between said tapered side wall and said first tapered midwall; and said second tapered midwall is arranged so that said insulating sheath of said third wire will be engaged between said tapered side wall and said second tapered midwall.

12. An electrical connection, comprising:

an electrical cable including:

first, second and third substantially co-planar, substantially parallel wires, said second wire being located between said first and third wires;

first and second substantially circular cross-section resilient tubular insulating sheaths disposed about said first and third wires, respectively;

a substantially oval cross-section resilient tubular insulating casing having said first, second and third wires received therein; and wherein free end portions of said first, second and third wires extend beyond a free end of said casing, and at least part of said free end portion of each of said first, second and third wires is bare;

a plug-in electrical wiring apparatus including a housing having a cable receiving external socket disposed therein, said socket being defined by a tapered side wall convergingly tapered toward a lower end of said socket, said lower end of said socket having first, second and third aligned housing openings disposed therethrough, said apparatus further including first, second and third wire receiving electrical contact means, disposed in said housing in registry with said first, second and third housing openings;

wherein said cable is received within said socket with said bare parts of said free end portions of said first, second and third wires disposed through said first, second and third housing openings, and contacting said first, second and third contact means, with said substantially oval cross-section casing of said cable wedgingly engaged with said tapered side wall;

wherein said first and second insulating sheaths disposed about said first and third wires, respectively, extend a distance beyond said free end of said casing;

wherein said socket of said housing further includes first and second tapered midwalls;

wherein said first housing opening is located between said side wall and said first tapered midwall, and said first insulating sheath is wedgingly engaged with said first tapered midwall; and wherein said third housing opening is located between said side wall and said second tapered midwall, and said second insulating sheath is wedgingly engaged with said second tapered midwall.

13. The electrical connection of claim 12, wherein:

said first insulating sheath is wedged between said tapered side wall and said first tapered midwall; and said second insulating sheath is wedged between said tapered side wall and said second tapered midwall.

14. A plug-in electrical wiring apparatus, comprising:

an insulating housing, having a plurality of aligned wire receiving housing openings disposed through a wall thereof; and an electrical contact strip disposed in said housing, said strip including:

an elongated middle web portion having a plurality of aligned wire receiving web openings disposed therethrough, each one of said web openings being in registry with one of said housing openings, said web portion further including retaining means for engaging said wire when said wire is inserted through one of said housing openings and the web opening in registry therewith and for resisting withdrawal of said wire from said web opening; and first and second elongated leg portions extending from said web portion away from said wall of said housing, said leg portions being arranged to engagingly receive said wire therebetween, at least one of said first and second leg portions being split transversely to a length thereof between adjacent ones of said web openings, so that said leg portions can engagingly receive different sizes of wire in adjacent web openings.

15. A plug-in electrical wiring apparatus, comprising:

an insulating housing comprising:

a first wall having a wire receiving housing opening disposed therethrough;

a second wall opposite said first wall;

a third wall extending at least partially between said first and second walls; and a fourth wall opposite said third wall and extending at least partially between said first and second walls;

wherein, said first, second, third and fourth walls define a groove of said housing; and an electrical contact strip disposed in said groove of said housing, said strip including:

a middle web portion having a wire receiving web opening disposed therethrough in registry with said wire receiving housing opening, said web portion further including retaining means for engaging said wire when said wire is inserted through said housing opening and said web opening and for resisting withdrawal of said wire from said web opening; and first and second leg portions extending from said web portion away from said first wall of said housing, said leg portions being arranged to engagingly receive said wire therebetween, wherein:

at least one of said first and second leg portions is constructed to resiliently flex away from said first and second leg portions when said wire is received therebetween; and said one of said first and second leg portions has a free end thereof engaging one of said third and fourth walls and spaced from said second wall so that when said one leg portion is flexed upon insertion of said wire, said free end of said one leg portion may move closer to said second wall.

16. The apparatus of claim 15, wherein:

at least a part of said one leg portion is arcuate in cross section with a convex side thereof facing the other of said first and second leg portions.

17. The apparatus of claim 16, wherein:

the other of said first and second leg portions has a planar part adjacent and offset toward said arcuate part of said one leg portion, so that said wire is engagingly gripped between said convex side of said arcuate part of said one leg portion and said planar part of said other leg portion with said one leg portion resiliently biased against said wire.

18. The apparatus of claim 15, wherein:

both of said first and second leg portions are constructed to resiliently flex away from each other when said wire is received therebetween; and both of said first and second leg portions have free ends thereof engaging said third and fourth walls, respectively, and spaced from said second wall so that when said first and second leg portions are flexed upon insertion of said wire, said free ends may move closer to said second wall.

19. The apparatus of claim 8, wherein:

each of said first and second leg portions has an offset planar portion offset toward the other of said leg portions, said offset planar portions being substantially parallel to each other and arranged so that said wire is engagingly gripped between said offset planar portions.

20. An electrical connection, comprising:

an electrical cable including:

first, second and third substantially co-planar, substantially parallel wires, said second wire being located between said first and third wires;

first and second substantially circular cross-section resilient tubular insulating sheaths disposed about said first and third wires, respectively;

a substantially oval cross-section resilient tubular insulating casing having said first, second and third wires received therein; and wherein free end portions of said first, second and third wires extend beyond a free end of said casing, and at least part of said free end portion of each of said first, second and third wires is bare;

a plug-in electrical wiring apparatus including a housing having a cable receiving external socket disposed therein, said socket being defined by a tapered side wall, said tapered side wall being substantially conical in shape with a substantially oval cross section, said tapered side wall being convergingly tapered toward a lower end of said socket, said lower end of said socket having first, second and third aligned housing openings disposed therethrough, said apparatus further including first, second and third wire receiving electrical contact means, disposed in said housing in registry with said first, second and third housing openings, wherein said first wire receiving electrical contact means includes:

a middle web portion having a first wire receiving web opening disposed therethrough in registry with said first housing opening, said web portion further including retaining means for engaging said first wire when said first wire is inserted through said first housing opening and said first web opening and for resisting withdrawal of said first wire from said first web opening; and first and second leg portions extending from said web portion away from said bottom wall of said socket, said leg portions being arranged to engagingly receive said first wire therebetween, at least one of said first and second leg portions being constructed to resiliently flex away from the other of said first and second leg portions so that said first wire is resiliently gripped between said first and second leg portions; and wherein said cable is received within said socket with said bare parts of said free end portions of said first, second and third wires disposed through said first, second and third housing openings, and contacting said first, second and third contact means, and with said substantially oval cross-section casing of said cable wedgingly engaged with said tapered side wall.

21. An electrical connection, comprising:

an electrical cable including:

first, second and third substantially co-planar, substantially parallel wires, said second wire being located between said first and third wires;

first and second substantially circular cross-section resilient tubular insulating sheath disposed about said first and third wires, respectively;

a substantially oval cross-section resilient tubular insulating casing having said first, second and third wires received therein; and wherein free end portions of said first, second and third wires extend beyond a free end of said casing, and at least part of said free end portion of said first, second and third wires is bare;

a plug-in electrical wiring apparatus including a housing having a cable receiving external socket disposed therein, said socket being defined by a tapered side wall, said tapered side wall being substantially conical in shape with a substantially oval cross section, said tapered side wall being convergingly tapered toward a lower end of said socket, said lower end of said socket having first, second and third aligned housing openings disposed therethrough, said apparatus further including first, second and third wire receiving electrical contact means, disposed in said housing in registry with said first, second and third housing openings, wherein said first wire receiving electrical contact means includes:

a middle web portion having a first wire receiving web opening disposed therethrough in registry with said first housing opening, said web portion further including retaining means for engaging said first wire when said first wire is inserted through said first housing opening and said first web opening and for resisting withdrawal of said first wire from said first web opening; and first and second leg portions extending from said web portion away from said bottom wall of said socket, said leg portions being arranged to receive said wire therebetween, such that said wire is grippingly engaged by said leg portions; and wherein said cable is received within said socket with said bare parts of said free end portions of said first, second and third wires disposed through said first, second and third housing openings, and contacting said first, second and third contact means, and with said substantially oval cross-section casing of said cable wedgingly engaged with said tapered side wall.

* * * * *

UNITED STATES PATENT AND TRADEMARK OFFICE

CERTIFICATE OF CORRECTION

PATENT NO. : 4,627,675

DATED : December 9, 1986

INVENTOR(S) : Phillip W. Stumpff and Richard D. Taylor

It is certified that error appears in the above-identified patent and that said Letters Patent are hereby corrected as shown below:

Column 15, line 42, delete "claim 4" and insert --claim 3-- therefor.

Column 16, line 18, delete "betwen" and insert --between-- therefor.

Column 18, line 51, delete "8" and insert --18-- therefor.

Signed and Sealed this

Tenth Day of March, 1987

*Attest:*

DONALD J. QUIGG

*Attesting Officer*

*Commissioner of Patents and Trademarks*